US009624723B2

(12) United States Patent
Fraser

(10) Patent No.: US 9,624,723 B2
(45) Date of Patent: Apr. 18, 2017

(54) APPLICATION OF DOWNHOLE ROTARY TRACTOR

(71) Applicant: Saudi Arabian Oil Company, Dhahran (SA)

(72) Inventor: Scott David Fraser, Aberdeen (GB)

(73) Assignee: Saudi Arabian Oil Company, Dhahran (SA)

( * ) Notice: Subject to any disclaimer, the term of this patent is extended or adjusted under 35 U.S.C. 154(b) by 348 days.

(21) Appl. No.: 14/062,390

(22) Filed: Oct. 24, 2013

(65) Prior Publication Data

US 2014/0116779 A1 May 1, 2014

Related U.S. Application Data

(60) Provisional application No. 61/718,926, filed on Oct. 26, 2012.

(51) Int. Cl.

| | |
|---|---|
| ***E21B 4/00*** | (2006.01) |
| ***E21B 4/18*** | (2006.01) |
| ***E21B 23/00*** | (2006.01) |

(52) U.S. Cl.

CPC ..... *E21B 4/00* (2013.01); *E21B 4/18* (2013.01); *E21B 2023/008* (2013.01)

(58) Field of Classification Search

CPC ... E21B 4/00; E21B 4/18; E21B 23/00; E21B 23/08; E21B 2023/008; E21B 43/10

(Continued)

(56) References Cited

U.S. PATENT DOCUMENTS

| | | | | |
|---|---|---|---|---|
| 4,192,380 | A | 3/1980 | Smith | |
| 5,649,603 | A * | 7/1997 | Simpson | E21B 4/18 166/241.3 |

(Continued)

FOREIGN PATENT DOCUMENTS

| | | | |
|---|---|---|---|
| WO | 00/46481 | A2 | 8/2000 |
| WO | 2008/091157 | A1 | 7/2008 |

(Continued)

OTHER PUBLICATIONS

PCT International Search Report and the Written Opinion of the International Searching Authority dated Jul. 2, 2014; International Application No. PCT/US2013/066724; International File Date: Oct. 25, 2013.

(Continued)

*Primary Examiner* — Michael Willis, III
(74) *Attorney, Agent, or Firm* — Bracewell LLP; Constance Gall Rhebergen

(57) ABSTRACT

A towing string useful for positioning a towed assembly into a horizontal well bore includes a towed assembly coupled to a tractor assembly. The tractor assembly is operable to convert introduced energy into a pulling force that is directed downhole. The tractor assembly includes a disposable motor and a coupled rotary tractor. The rotary tractor has a rotating portion that is operable to rotate around a central axis of the rotary tractor and a rotary element that is operable to frictionally engage the well bore wall. A method for using the towing string for positioning the towed assembly in the horizontal section includes introducing the towing string into the horizontal well bore, operating the towing string such that the rotary element frictionally engages the well bore wall, and introducing energy to the towing string such that the tractor assembly provides a pulling force directed downhole.

29 Claims, 1 Drawing Sheet

(58) Field of Classification Search
USPC ..... 175/51; 104/138.1, 138.2
See application file for complete search history.

(56) References Cited

U.S. PATENT DOCUMENTS

| | | | | |
|---|---|---|---|---|
| 5,749,397 | A | 5/1998 | Molaug | |
| 5,947,213 | A | 9/1999 | Angle et al. | |
| 6,112,809 | A * | 9/2000 | Angle | E21B 4/18 166/50 |
| 6,241,031 | B1 | 6/2001 | Beaufort et al. | |
| 6,273,189 | B1 * | 8/2001 | Gissler | E21B 4/04 166/241.1 |
| 6,467,557 | B1 | 10/2002 | Krueger et al. | |
| 8,011,429 | B2 * | 9/2011 | McNay | E21B 17/1057 166/241.1 |
| 8,151,902 | B2 * | 4/2012 | Lynde | E21B 23/14 166/65.1 |
| 2003/0034177 | A1 | 2/2003 | Chitwood et al. | |
| 2008/0196901 | A1 | 8/2008 | Aguirre et al. | |
| 2012/0222857 | A1 | 9/2012 | McNay | |

FOREIGN PATENT DOCUMENTS

| | | | |
|---|---|---|---|
| WO | 2009/020397 | A1 | 2/2009 |
| WO | 2012/143722 | A2 | 10/2012 |

OTHER PUBLICATIONS

Peters, R. B., et al., Development of an Autonomous Logging Tool Enabling Injection Well Flow Profile Logging in Deep Extended Reach and Horizontal Wells; SPE International Production and Operations Conference and Exhibition—Doha Qatar; May 14-16, 2012; Society of Petroleum Engineers.

* cited by examiner

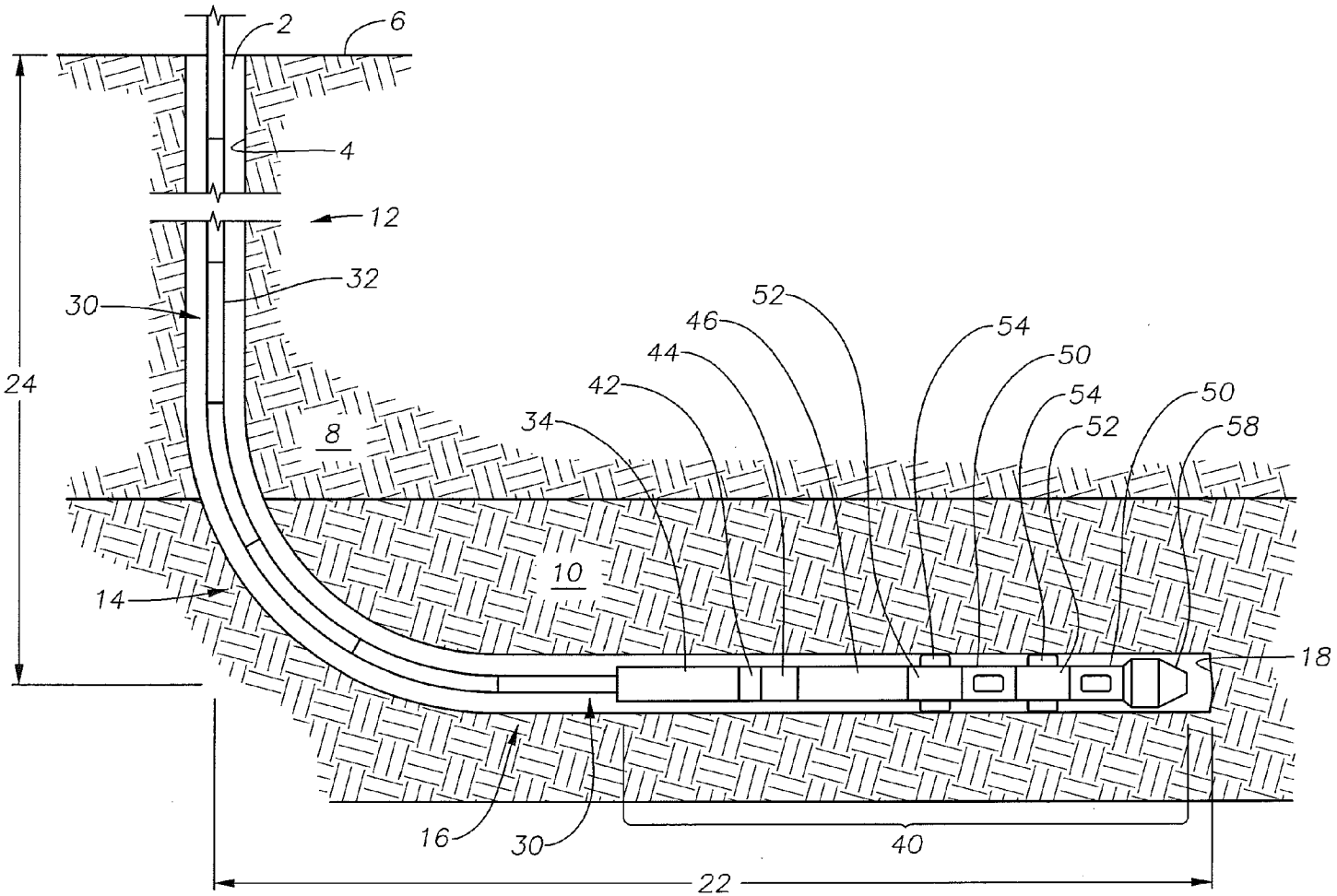
6
2
4
12
32
8
30
24
14
10
34
42
44
46
52
54
50
54
52
50
58
18
16
30
40
22

APPLICATION OF DOWNHOLE ROTARY TRACTOR

CROSS-REFERENCE TO RELATED PATENT APPLICATIONS

This application claims priority from U.S. Provisional Application No. 61/718,926, filed Oct. 26, 2012. For purposes of United States patent practice, this application incorporates the contents of the Provisional Application by reference in its entirety.

BACKGROUND OF THE INVENTION

1. Field of the Invention

The field of invention relates to a device and method for using a rotary tractor in a horizontal well bore.

2. Description of the Related Art

In horizontal drilling, there are many challenges to maintaining operations that are not present in vertical or even deviated systems. Gravity pulls the metal drill pipes, the drill collars, the drill bit and downhole tools against the walls of the well bore. The frictional force generated both while moving and when idle can damage the equipment. Much more energy is required to move a similar distance from the surface entry point horizontally than vertically. Today, extended reach completions reaching 10,000 to 12,000 horizontal feet in unlined or minimally lined well bores exist. Longer distances are envisioned.

During the running of intelligent completion systems, hydraulic or electrical lines, or both, are positioned on the exterior of piping or tubing. The control and electrical lines permit the operation of mechanical sleeves and equipment in the downhole environment as well as provide a conduit for transferring data and commands. Introducing these systems into a horizontal well having a long horizontal section, including extended reach wells (ERWs), multi-lateral and multi-tier wells and exposes operational difficulties. These systems by themselves have difficulty reaching the technical objective (that is, the end of the well bore or Total Depth) due to the effect of gravity and friction.

Overcoming the friction of the horizontal section of the horizontal well bore is a significant, problem. Sometimes rotating the drill string temporarily overcomes by transferring the axial friction vector into a rotational vector. However, this is not recommended with intelligent systems because rotating the drill string can damage the external control and electrical lines and cause the completion to fail. Since an intelligent completion string cannot be rotated, the exposure to friction increases with the length of the horizontal section. Lubricants in the wellbore can reduce some effects of friction; however, their use can add complexity in terms of reservoir damage and cleanup. Lubricants are costly and only marginally reduce friction (±10 to 20%). Centralizers can help to overcome friction while running into wells. Centralizers can be made from composites that have a lower coefficient of friction than the drill string and assembly. Centralizers, however, have to be placed regularly along the length of the well bore and are prone to breaking and being pulled apart on the unlined well bore wall.

SUMMARY OF THE INVENTION

A towing string is useful for positioning an included towed assembly into a horizontal well bore. The towed assembly has an internal fluid conduit along its operative length from the surface to a leading edge. The towing string also has a tractor assembly coupled to the leading edge of the towed assembly. The tractor assembly is operable to convert introduced energy into a pulling force that is directed downhole. The tractor assembly includes a disposable motor. The disposable motor is operable to receive introduced energy, convert the energy into power and then convey the power to a coupled rotary tractor. The rotary tractor is downhole of the disposable motor. The rotary tractor has a rotation portion that is operable to rotate around a central axis of the rotary tractor. The rotary tractor also has a rotary element that couples to the rotation portion. The rotary element is operable to frictionally engage the well bore wall. The rotary tractor is also operable to convert the power received from the disposable motor into a rotational force that drives the rotating portion of the rotary tractor around the central axis.

A method for using the towing string for positioning the towed assembly in the horizontal section of the horizontal well bore includes the step of introducing the towing string into the horizontal well bore. The towing string has the towed assembly coupled to the tractor assembly. The tractor assembly includes the disposable motor coupled to the rotary tractor. The rotary tractor has a rotary element that is operable to frictionally engage the well bore wall. The method also includes the step of operating the towing string such that the rotary element frictionally engages the well bore wall. The method also includes introducing energy to the towing string such that the tractor assembly provides a pulling force directed downhole. The pulling force directed downhole positions the towed assembly in the horizontal section of the horizontal well bore.

The method is useful for deploying a drill string, completion string, production liner, casing, test string, coil tubing, intelligent completion string, and other downhole tools or systems into extended reach wells. The method of use of the rotary tractor assembly permits lowering the drill or completion string into the well. When downward motion at the surface can no longer overcome the drag on the string in the horizontal section, the downhole motor can provide power to the forward active rolling element tractor. The rotary tractor assembly adds a downhole pulling force that is advantageous over mere friction reduction. The power supplied is sufficient to reduce and overcome the countervailing forces of static and moving friction acting on the string and permit continued introduction into the well bore. Adding a pulling force located in the well bore reduces the axial drag and counteracts the tendency of the pipe to buckle under high compression loading, which tends to occur when pushing from the surface alone.

The method can also benefit sand control screens using an inner circulation string.

The method is useful for installing pipe and drill strings and attached tools in longer horizontal well sections than previously possible. Addition of the rotary tractor assembly permits introduction of the string or tools into the very end of the wellbore. The rotary tractor assembly can occupy or be disposed of in unproductive areas or 'rat hole' extensions of the well bore at the very end of the horizontal well. This can maximize the exposure of strings, completion tools and measuring devices to the well bore wall acting as the interface with the hydrocarbon-bearing formation.

BRIEF DESCRIPTION OF THE DRAWINGS

These and other features, aspects, and advantages of the present invention are better understood with regard to the following Detailed Description of the Preferred Embodiments, appended Claims, and accompanying Figures, where:

FIG. 1 is a general schematic of an embodiment of a towing string with the rotary tractor assembly in a horizontal well bore.

DETAILED DESCRIPTION OF THE PREFERRED EMBODIMENTS

The Specification, which includes the Summary of Invention, Brief Description of the Drawings and the Detailed Description of the Preferred Embodiments, and the appended Claims refer to particular features (including process or method steps) of the invention. Those of skill in the art understand that the invention includes all possible combinations and uses of particular features described in the Specification. Those of skill in the art understand that the invention is not limited to or by the description of embodiments given in the Specification. The inventive subject matter is not restricted except only in the spirit of the Specification and appended Claims.

Those of skill in the art also understand that the terminology used for describing particular embodiments does not limit the scope or breadth of the invention. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a", "an", and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced. The verb "couple" and its conjugated forms means to complete any type of required junction, including electrical, mechanical or fluid, to form a singular object from two or more previously non-joined objects. Coupling can occur either directly or through a common connector. "Optionally" and its various forms means that the subsequently described event or circumstance may or may not occur. The description includes instances where the event or circumstance occurs and instances where it does not occur.

Spatial terms describe the relative position of an object or a group of objects relative to another object or group of objects. The spatial relationships apply along vertical and horizontal axes. Orientation and relational words including "uphole" and "downhole"; "upstring" and "downstring"; "above" and "below"; "up" and "down" and other like terms are for descriptive convenience and are not limiting unless otherwise indicated.

Where a range of values is provided in the Specification or in the appended Claims, it is understood that the interval encompasses each intervening value between the upper limit and the lower limit as well as the upper limit and the lower limit. The invention encompasses and bounds smaller ranges of the interval subject to any specific exclusion provided.

Where reference is made in the Specification and appended Claims to a method comprising two or more defined steps, the defined steps can be carried out in any order or simultaneously except where the context excludes that possibility.

The "inclination angle" of a well bore is the measure of deviation in angle from true vertical from the perspective of traversing downward through the well bore from the surface. An angle of 0° degree downward is "true vertical". An angle of 90° from true vertical is "true horizontal". A "horizontal run", "leg" or "section" is a portion of the well bore where the inclination angle of the well bore is equal to or greater than 65° from true vertical, including values above true horizontal up to 115° from true vertical. A "horizontal well" is a well that has a well bore with a horizontal run for a portion of the well bore length. Horizontal wells have other portions of the well bore that are less than 65° in angle, including the vertical run that connects the well bore with the surface through a surface entry point.

FIG. 1

FIG. 1 is a general schematic of an embodiment of the towing string with the rotary tractor in the horizontal well bore. FIG. 1 and its description facilitate a better understanding of the rotary tractor assembly and its method of use. In no way should FIG. 1 limit or define the scope of the invention. FIG. 1 is a simple diagram for ease of description.

FIG. 1 is a useful reference to describes general aspects of the horizontal well and the towing string. Well bore 2 is a space defined by well bore wall 4. Well bore 2 forms a fluid pathway that extends from surface 6, through non-hydrocarbon bearing formation 8 and into hydrocarbon-bearing formation 10. Well bore 2 has several sections, including vertical run 12, transition zone 14 and horizontal section 16. Horizontal section 16 extends in a generally horizontal direction from transition zone 14 until reaching the distal end of well bore 2, which is well bore face 18. Well bore 2 contains well bore fluid. Well bore 2 has a horizontal run length 22 that is much longer than its total vertical depth (TVD) 24. Both horizontal run length 22 and total vertical depth (TVD) 24 are useful for determining operative length of well bore 2.

FIG. 1 also shows towing string 30 already introduced into well bore 2. Completion tubing 32, forming part of a completion string, comprises most of towing string 30. Further downhole of completion tubing 32, towing string 30 includes completion assembly 34. Completion assembly 34 includes tools and devices, including pipeline or tubing, for securing the completion string in horizontal section 16 of well bore 2 where hydrocarbon production is to occur. Hydrocarbons when produced will flow through completion assembly 34 and up the completion tubing 32 to surface 6.

As shown in FIG. 1, downhole of completion assembly 34 is tractor assembly 40. Tractor assembly 40 couples to completion assembly 34 through connector 42. Tractor assembly includes torque dampener 44, which prevents rotational motion generated by tractor assembly 40 from traversing uphole and affecting the stability or handling of towing string 30. Disposable motor 46 couples to and provides power to several rotary tractors 50 downstring.

Each rotary tractor 50 includes rotating portion 52 that is operable to rotate around the central axis of each rotary tractor 50. Each rotating portion 52 couples to several rotary elements 54, which in FIG. 1 are frictionally engaged with well bore wall 4. Reamer shoe 58 is the lead element of towing string 30 and is operable to clear any blockage from the pathway of towing string 30 as it is positioned in horizontal section 16 of well bore 2.

Under power from disposable motor 46, rotating portion 52 for each rotary tractor 50 rotates around the central axis of its rotary tractor 50. With rotary elements 54 frictionally engaged with well bore wall 4, tractor assembly 40 converts introduced energy into a pulling force directed downhole, pulling towing string 30 further downhole along horizontal section 16 towards well bore face 18. Multiple rotary tractors 50 provide additive pulling force that overcomes friction of completion tubing 32 and completion assembly 34 in horizontal run 16.

Towed Assembly

The towing string includes a towed assembly. The towed assembly can include a drill string, a completion string, a production liner, casing, a test string, coil tubing, intelligent completion piping, sand control screens, and piping or tubing with exterior hydraulic or electrical lines, or both. An embodiment of the towing string includes where the towed assembly is a completion string. An embodiment of the towing string includes where the towed assembly includes intelligent pipe.

The towed assembly is a fluid conduit, where the assembly has an internal fluid conduit running from the surface to a leading end of the fluid conduit. The internal fluid conduit runs the operative length of the towed assembly to provide fluid mobility not only during introduction of the towed assembly into the well bore but for producing fluids from the well bore after installation.

Tractor Assembly

The tractor assembly couples to the leading end of the towed assembly and is operable to convert introduced energy into a pulling force directed downhole. The tractor assembly includes the disposable motor and the rotary tractor. The tractor assembly optionally can include the connector. The tractor assembly optionally can include pieces of equipment to lead the assembly, including a bullnose or a reamer.

Other forms of tractors used in downhole systems, including wheeled tractors with axially-aligned wheel systems and "inch-worm" motion systems that "crawl" through the well bore, are not useful as part of the tractor assembly.

Connector

The tractor assembly couples to the towed assembly in the towing string. The tractor assembly can directly couple to the towed assembly. An embodiment of the towing string includes a connector that couples the tractor assembly to the towed assembly. The connector on the upstring end of the tractor assembly with structurally different parts of the towed assembly, including completion tubing, tools and drill pipe. An embodiment of the connector includes an internal fluid conduit passageway that permits fluid flow through the connector between portions of the introduced string upstring and downstring of the connector. An embodiment of the connector includes intelligent pipe or electrical connections to permit electrical power or signal communications, or both, between the tractor assembly and the towed assembly.

An embodiment of the towing string includes a connector that is operable to decouple the tractor assembly from the towed assembly. An embodiment of the towing string includes a connector that is operable to decouple the tractor assembly from the towed assembly by disengaging a mechanical lock. The mechanical lock can disengage using a variety of known techniques, for example, by using pre-determined string maneuvers such as combinations of string rotation, spinning and jarring, or by introducing a flow obstruction into the internal fluid conduit of the towing string, for example, a ball or a dart.

An embodiment of the towing string includes where the connector is operable to receive a pre-designated signal and is selectively operable to decouple the tractor assembly from the towed assembly. Transmission of the pre-designated command signal can occur using a variety of known downhole communications and telemetry techniques. An embodiment of the towing string includes where the tractor assembly is operable to receive a pre-designated command signal wirelessly. An embodiment of the towing string includes where the towed assembly comprises intelligent pipe. For example, wireless surface telemetry systems can transmit the pre-designated command signal downhole through the towing string, through the fluid in the well bore or through the surface of the earth. Several known wireless telemetry techniques are useful for transmitting wireless pre-designated command signal between the surface and downhole, including mud pulse telemetry, electromagnetic (EM) telemetry and acoustic telemetry, especially solid acoustic telemetry. Intelligent drill pipe and electrical cable are operable to convey transmitted pre-designated command signal using cable and wire, virtually eliminating signal noise.

An embodiment of the towing string includes where the connector is operable to absorb reactive torque produced by the disposable motor and the rotary tractor.

Disposable Motor

Useful disposable motor designs are for reliable operation on a one-way trip downhole. Operations such as completion, especially in ERWs, do not lend themselves to recovery of the equipment in the tractor assembly. The disposable motor in the tractor assembly is sufficient to supply power to the number and rating of the rotary tractors included in the tractor assembly to meet or exceed the required towing rate for the amount of weight being pulled downhole. The disposable motor is operable to receive introduce energy, to convert the received introduced energy into power, and to convey power to the coupled rotary tractor.

The motor design favors disposability with attention towards reliable single-use operation. An embodiment of the towing string includes where the disposable motor is operable to convert introduced hydraulic energy into mechanical power. Examples include positive-displacement mud motors and common drilling motors. An embodiment of the towing string includes where the disposable motor is operable to convert introduced electrical energy into mechanical power. Such a disposable motor can run on power introduced from the surface or from a combination of surface power and locally-stored electrical power, including a battery pack.

An embodiment of the towing string includes where the tractor assembly is operable to receive a pre-designated command signal and the disposable motor is selectively operable to convert introduced energy into power. Based upon the received pre-designated command signal and association with the associated operation, the disposable motor operates either to convert available introduced energy into power for the rotary tractor or it does not. Such a configuration allows for quick "on-off" of the disposable motor and cessation or progression of the downward traversal of the towing string and diversion of the introduced energy to other parts of the towing string or well bore.

Rotary Tractor

The tractor assembly includes a rotary tractor to pull the towing string, which includes the towed assembly, downhole. The rotary tractor provides the pulling force to overcome both the static and moving countervailing frictional forces present in the horizontal well bore on the towing string. The rotary tractor couples to the disposable motor downhole of the motor such that the rotary tractor pulls the disposable motor and the towed assembly downhole.

The tractor assembly includes one or more rotary tractors. An embodiment of the towing string provides that the number of rotary tractors in the tractor assembly is in a range of from one to four. Each rotary tractor provides additive power—each additional rotary tractor couples in series to the disposable motor and provides cumulative force for moving the towing string. An embodiment of the towing string includes where the pulling force directed downhole is sufficient to move at least about 5,000 pounds of weight at a rate of at least about 30 feet per minute through the horizontal section of the horizontal well bore. An embodiment of the towing string includes where the tractor assembly is operable to pull at least about 20,000 pounds of weight at a rate of at least about 30 feet per minute through the horizontal section.

The rotary tractor has the rotating portion that is operable to rotate around the central axis of the rotary tractor. The rotary tractor converts the received power from the coupled disposable motor into a rotational force for driving the rotating portion to rotate around the central axis. An embodiment of the rotary tractor converts electrical power into the rotational force. An embodiment of the rotary tractor converts mechanical power into the rotational force.

The rotary tractor has the rotary element that is operable to frictionally engage the well bore wall of the horizontal well bore. The rotary element couples to the rotating portion of the rotary tractor. Usually the rotary tractor has more than one rotary element to maintain the position of the tractor assembly in the middle of the horizontal well bore while in operation. The rotary element, frictionally engaged with the well bore wall, converts the rotational force generated by the rotational portion into the pulling force directed downhole. The rotation of the rotary element around the rotary tractor as the rotating portion moves in combination with the pulling force directing downhole created by the rotary tractor combines to create a travel pathway for the rotary element along the well bore wall that is helical in form.

An embodiment of the towing string includes where the tractor assembly is operable to receive a pre-designated command signal and the rotary tractor is selectively operable to frictionally engage the well bore wall with the rotary element. Based upon the received pre-designated command signal and association with the associated operation, the rotary tractor can permit frictionally engagement of the well bore wall with the rotary element and frictionally disengaging from the well bore wall.

Method of Using a Towing String

A method for using a towing string for positioning a towed assembly in the horizontal section of a horizontal well bore includes introducing the towing string into the horizontal well bore. The towing string includes a towed assembly coupled to a tractor assembly, and the tractor assembly has a disposable motor coupled to a rotary tractor as previously described.

The method of using a towing string includes operating the towing string such that the rotary element frictionally engages the well bore wall. An embodiment of the method includes transmitting a pre-designated command signal such that the rotary element engages the well bore wall frictionally. An embodiment of the method includes transmitting the pre-designated command signal such that the rotary element engages the well bore wall frictionally when the tractor assembly is located in the horizontal section.

An embodiment of the method includes transmitting a pre-designated command signal such that the rotary element does not engage the well bore wall frictionally. Such an embodiment is useful if the towing string must be relocated uphole after positioning.

The method of using a towing string includes introducing energy to the towing string such that the tractor assembly provides a pulling force directed downhole, positioning the towed assembly in the horizontal section of the horizontal well bore. Energy introduced from the surface supplies the means for generating power at the rotary tractor. An embodiment of the method includes introducing hydraulic energy through the internal fluid conduit of the towed assembly. An embodiment of the method includes introducing electrical energy through the towed assembly. A disposable motor that can convert electricity into power can receive the electricity through electrical conduit or intelligent pipe circuits.

An embodiment of the method includes transmitting a pre-designated command signal such that such that the disposable motor converts introduced energy into power. An embodiment of the method includes transmitting a pre-designated command signal such that such that the disposable motor does not convert introduced energy into power.

An embodiment of the method includes where the pulling force is operable to move at least about 5,000 pounds of weight downhole at a rate of at least 30 feet per minute through the horizontal section. An embodiment of the method includes where the pulling force is operable to move at least about 10,000 pounds of weight downhole at a rate of at least 30 feet per minute through the horizontal section. An embodiment of the method includes where the pulling force is operable to move at least about 15,000 pounds of weight downhole at a rate of at least 30 feet per minute through the horizontal section. An embodiment of the method includes where the pulling force is operable to move at least about 20,000 pounds of weight downhole at a rate of at least 30 feet per minute through the horizontal section. Downhole motion of the towed string, the ability to introduce the towed string further into the horizontal well bore or an increase in available hookload indicates that the tractor assembly is providing adequate pulling force for the towed assembly to progress further downhole.

The horizontal well bore can have locations where the tractor assembly can avoid interfering with the towed assembly after introduction into the horizontal section of the horizontal well bore. Examples of non-productive extensions include rat holes, dead legs, well boots and portion of the horizontal leg beyond the hydrocarbon-producing section of the hydrocarbon-bearing formation, including further downhole of the hydrocarbon-bearing formation. An embodiment of the method includes operating the towing string such that the tractor assembly decouples from the towed assembly in the horizontal section. An embodiment of the method includes transmitting a pre-designated command signal such that the tractor assembly decouples from the towed assembly.

Pre-forming a horizontal well bore with a non-productive extension is useful to place the tractor assembly out of the way of the towed assembly after use. An embodiment of the method includes forming the horizontal well bore with the non-productive extension, where the non-productive extension is operable to contain at least a portion of the tractor assembly. An embodiment of the method includes forming the non-productive extension downhole of the horizontal section. An embodiment of the method includes positioning the towing string such that at least a portion of the tractor assembly is located in the non-productive extension of the horizontal well bore. An embodiment of the method includes decoupling the tractor assembly such that at least a portion of the tractor assembly remains in the non-productive extension.

Upon decoupling from the towed assembly, the tractor assembly is no longer operable. Once decoupled, the towed assembly is free for surface-based manipulation, positioning and operations, including permanent installation (cementing, production charge detonation), testing and monitoring of the horizontal section of the well bore and removal of the towed assembly string from the well bore due to unexpected circumstances.

What is claimed is:

1. A towing string useful for positioning a towed assembly into a horizontal well bore, the towing string comprising:

the towed assembly having a completion string and a completion assembly along an operative length from a surface to a leading end, the completion assembly including a securing device operable to secure the completion string within the horizontal wellbore during production of hydrocarbons through the completion assembly, and wherein the completion string includes a flow path between the completion assembly and the surface that is sized to produce hydrocarbons from the completion assembly to the surface;

a tractor assembly that couples to the leading end of the towed assembly that is operable to convert introduced energy into a pulling force directed downhole, the tractor assembly including a rotary tractor; and a motor, wherein the rotary tractor is coupled to the motor in a position downhole of the motor, the rotary tractor having a rotating portion that is operable to rotate around a central axis of the rotary tractor, and a rotary element that couples to the rotating portion and is operable to frictionally engage a well bore wall of the horizontal well bore, the rotary tractor operable to convert the received power into a rotational force for driving the rotating portion to rotate around the central axis.

2. The towing string of claim 1 where the completion string comprises intelligent pipe.

3. The towing string of claim 1 where the motor is operable to convert introduced hydraulic energy into mechanical power.

4. The towing string of claim 1 where the motor is operable to convert introduced electrical energy into mechanical power.

5. The towing string of claim 1 where the tractor assembly is operable to receive a pre-designated command signal and the motor is selectively operable to convert introduced energy into power.

6. The towing string of claim 1 where the rotary tractor is operable to convert mechanical power into the rotational force.

7. The towing string of claim 1 where the rotary tractor is operable to convert electrical power into the rotational force.

8. The towing string of claim 1 where the tractor assembly is operable to receive a pre-designated command signal and the rotary tractor is selectively operable to frictionally engage the well bore wall of the horizontal well bore.

9. The towing string of claim 1 where the pulling force directed downhole is sufficient to move at least about 5,000 pounds of weight at a rate of at least about 30 feet per minute through the horizontal section.

10. The towing string of claim 1 where the tractor assembly is operable to pull at least about 20,000 pounds of weight at a rate of at least about 30 feet per minute through the horizontal section.

11. The towing string of claim 1 where the number of rotary tractors in the tractor assembly is in a range of from one to four.

12. The towing string of claim 1 further comprising a connector that couples the tractor assembly to the towed assembly.

13. The towing string of claim 12 where the connector is operable to decouple the tractor assembly from the towed assembly by disengaging a mechanical lock.

14. The towing string of claim 12 where the connector is operable to receive a pre-designated signal and is selectively operable to decouple the tractor assembly from the towed assembly.

15. The towing string of claim 1 where the tractor assembly further comprises a connector operable to absorb reactive torque produced by the motor and the rotary tractor.

16. The towing string of claim 1 where the tractor assembly is operable to receive a pre-designated command signal wirelessly.

17. A method for using a towing string for positioning a towed assembly in a horizontal section of a horizontal well bore comprising the steps of:

introducing the towing string into the horizontal well bore, where the horizontal well bore is defined by a well bore wall, where the towing string has a completion string coupled to a tractor assembly, where the tractor assembly comprises a motor coupled to a rotary tractor, and where the rotary tractor has a rotary element that is operable to frictionally engage the well bore wall of the horizontal well bore;

rotating a portion such that the rotary element frictionally engages the well bore wall;

introducing energy to the towing string such that the tractor assembly provides a pulling force directed downhole such that the towed assembly is positioned in the horizontal well bore; and securing the completion string within the horizontal well bore and producing hydrocarbons through the completion string to a surface.

18. The method of claim 17 where the introduced energy is hydraulic energy.

19. The method of claim 17 where the introduced energy is electrical energy.

20. The method of claim 17 where the tractor assembly is operable to receive a pre-designated command signal and the motor is selectively operable to convert introduced energy into power, the method further comprising the step of transmitting a pre-designated command signal such that the motor converts introduced energy into power.

21. The method of claim 17 where the pulling force is operable to move at least about 5,000 pounds of weight downhole at a rate of at least 30 feet per minute through the horizontal section.

22. The method of claim 17 further comprising the step of operating the towing string such that the tractor assembly decouples from the towed assembly in the horizontal section.

23. The method of claim 22, where the tractor assembly decouples from the towed assembly in the horizontal section prior to producing hydrocarbons through the completion string to a surface.

24. The method of claim 22, where upon the tractor assembly decoupling from the towed assembly in the horizontal section, the tractor assembly is no longer operable.

25. The method of claim 17 where the towing string is operable to receive a pre-designated command signal and is selectively operable to decouple the tractor assembly from the towed assembly, further comprising the step of transmitting a pre-designated command signal such that the tractor assembly decouples from the towed assembly.

26. The method of claim 25 where the transmission occurs wirelessly.

27. The method of claim 17 where the tractor assembly is operable to receive a pre-designated command signal and the rotary tractor is selectively operable to frictionally engage the well bore wall of the horizontal well bore with the rotary element, further comprising the step of transmitting a pre-designated command signal such that the rotary element engages the well bore wall frictionally.

28. The method of claim 27 where the transmission of the pre-designated command signal occurs when the rotary tractor assembly is located in the horizontal section of the horizontal well bore.

29. The method of claim 17 where the tractor assembly is operable to receive a pre-designated command signal and the rotary tractor is selectively operable to frictionally engage the well bore wall of the horizontal well bore with the rotary element, further comprising the step of transmitting a pre-designated command signal such that the rotary element does not engage the well bore wall frictionally.

* * * * *